United States Patent [19]

Buetemeister et al.

[11] Patent Number: 4,731,543

[45] Date of Patent: Mar. 15, 1988

[54] ELECTRIC STARTING MOTOR CONTROL SYSTEM

[75] Inventors: Earl H. Buetemeister, Alexandria; John R. Spears, Anderson, both of Ind.

[73] Assignee: General Motors Corporation, Detroit, Mich.

[21] Appl. No.: 44,656

[22] Filed: May 1, 1987

[51] Int. Cl.[4] ..... F02N 11/08

[52] U.S. Cl. ..... 290/38 R

[58] Field of Search ..... 290/36 R, 38 R, 38 C, 290/38 E, DIG. 1, DIG. 3; 123/179 B; 307/571

[56] References Cited

U.S. PATENT DOCUMENTS

| | | | |
|---|---|---|---|
| 2,287,791 | 6/1942 | Dyer | 290/38 E |
| 3,076,098 | 1/1963 | Colvill et al. | 290/36 R |
| 3,959,662 | 5/1976 | Hartley | 290/38 R |
| 4,418,289 | 11/1983 | Mortensen | 290/38 R X |
| 4,420,700 | 12/1983 | Fay et al. | 307/571 |
| 4,551,630 | 11/1985 | Stahura et al. | 290/38 R |
| 4,586,467 | 5/1986 | Raver | 290/38 R X |

*Primary Examiner*—William M. Shoop, Jr.
*Assistant Examiner*—W. E. Duncanson, Jr.
*Attorney, Agent, or Firm*—C. R. Meland

[57] ABSTRACT

A starting system for cranking an internal combustion engine that has a starter that is comprised of a solenoid and an electric cranking motor. The solenoid has pull-in and hold-in coils which when energized cause a pinion gear to be shifted into mesh with the ring gear of the engine to be cranked. Energization of the coils is controlled by at lest one N-channel field effect transistor which has its source connected to the negative terminal of a direct voltage source. A start switch is connected between the positive terminal of the voltage source and the gate of the transistor. When the start switch is closed the transistor is biased conductive to energize the pull-in and hold-in coils. The system may include a plurality of parallel connected N-channel transistors. The system inhibits turn-on of the transistor in the event that an excessive voltage is applied to the system. The system has transient voltage protection features.

7 Claims, 2 Drawing Figures

ELECTRIC STARTING MOTOR CONTROL SYSTEM

Figure 1:
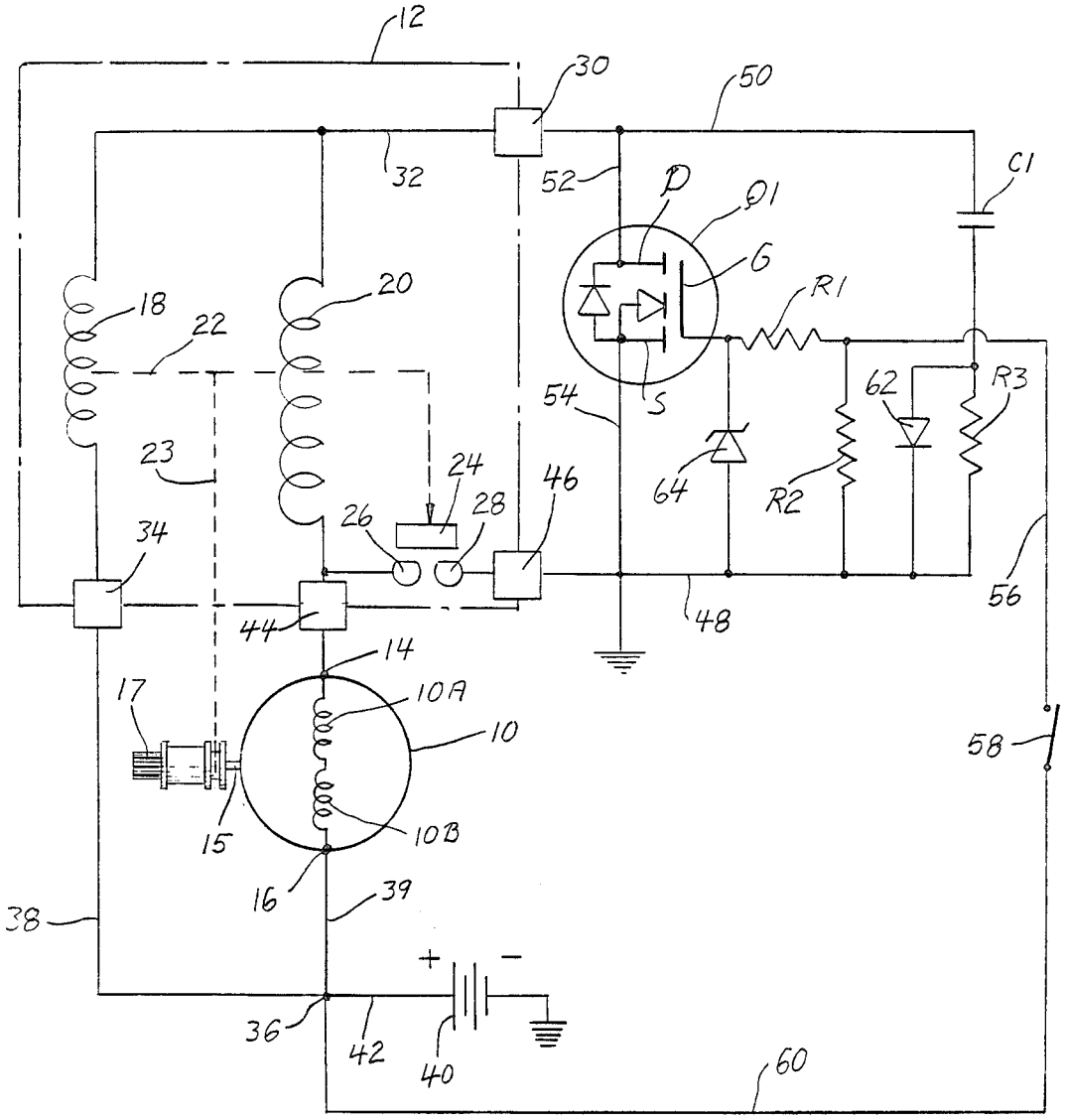

This invention relates to electric starting apparatus for cranking an internal combustion engine and more particularly to a starting system that utilizes an electric starter of the type that has a solenoid comprised of pull-in and hold-in coils which, when energized, shift a plunger which in turn shifts a pinion into mesh with the ring gear of the engine to be cranked.

Electric starting systems that employ a starter that has a solenoid that has pull-in and hold-in coils and wherein current flow to the coils is controlled by switching a bipolar transistor or transistors on and off are known, examples being the systems disclosed in the U.S. patents to Colvill et al. U.S. Pat. No. 3,076,098 and Raver U.S. Pat. No. 4,586,467. In the Colvill et al. patent a plurality of parallel connected PNP transistors control the current supplied to the pull-in and hold-in coils of an electric starter. In the Raver patent the current flow to the pull-in coil is controlled by a Darlington connected NPN transistor. The PNP transistors in the Colvill et al. patent are connected in what may be termed a high side drive connection since they are connected between the positive terminal of the battery and the starting motor and the opposite side of the starting motor is grounded.

Instead of using bipolar transistors to control pull-in and hold-in coil current of an electric starter it would be desirable to use metal oxide field effect transistors because, among other things, they have less voltage drop when biased conductive than a bipolar transistor. Other advantages of metal oxide field effect transistors, as compared to bipolar transistors, is that they can be switched fast and have extremely high gain.

Metal oxide field effect transistors (MOSFETS) can be of the P-channel or N-channel enhancement mode type. Where the current to the pull-in and hold-in coils is of the order of 120 amps a P-channel field effect transistor cannot be used because it cannot handle 120 amps. N-channel field effect transistors can handle the higher currents and generally have a lower on-resistance than P-channel field effect transistors.

This invention utilizes N-channel field effect transistors to control pull-in and hold-in coil current and connects the N-channel field effect transistor in such a manner, with the positive and negative terminals of a direct voltage source, as to simplify the circuitry for biasing the transistor on and off. Thus, instead of connecting an N-channel transistor in a high side drive configuration where the drain and source are connected between the positive terminal of the voltage source and the coils the N-channel transistor is connected in a low side drive configuration such that the drain of the transistor is connected to the coils and the source of the transistor is connected to the negative terminal of the voltage source. With this low side drive arrangement no voltage level shifter is required to bias the transistor on since this can be accomplished by simply applying the positive voltage of the voltage source to the gate of the N-channel transistor. It accordingly is an object of this invention to provide a starting motor control system wherein an N-channel field effect transistor controls pull-in and hold-in coil current and wherein the N-channel transistor is so connected with a source of direct voltage that no voltage level shifter is required in order to bias the transistor conductive.

Another object of this invention is to povide a starting motor control system of the type described wherein a plurality of parallel connected N-chnnel transistors are utilized.

Another object of this invention is to provide a starting motor control system of the type described wherein a Zener diode is connected across the gate and source of the N-channel transistor to limit the voltage applied to the gate of the transistor in the event that an attempt is made to jump start the system with an excessively high voltage.

Another object of this invention is to provide a starting motor control system of the type described wherein the energization of the cranking motor of the electric starter is inhibited in the event that an attempt is made to jump-start the system with an excessively high voltage.

Another object of this invention is to provide a starting motor control system of the type described wherein the N-channel transistor is protected from voltage transients that are developed by the hold-in coil when it is deenergized.

IN THE DRAWINGS

Figure 2:
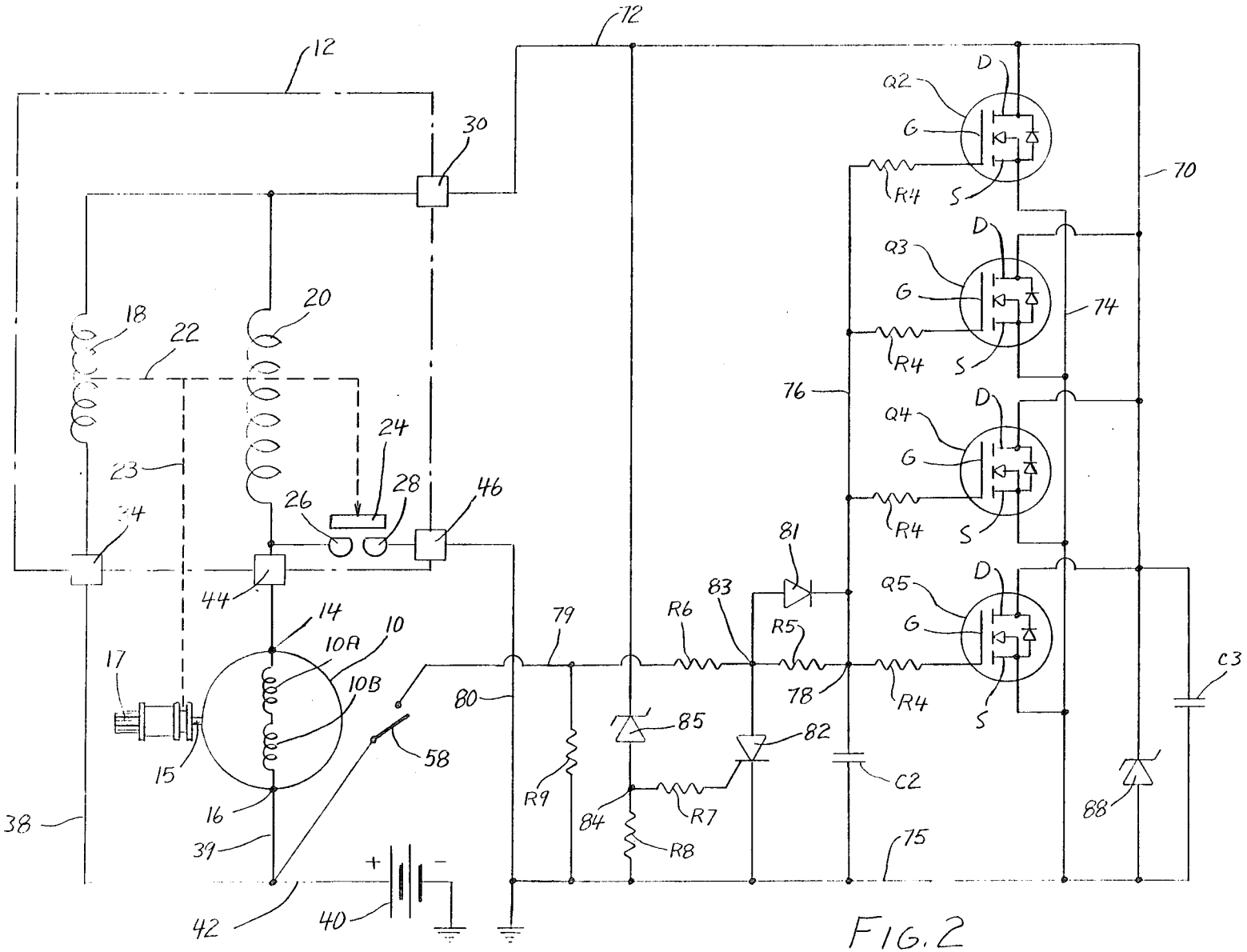

FIG. 1 is a schematic circuit diagram of an electric starting motor control system made in accordance this invention; and FIG. 2 is a schematic circuit diagram of a modified electric starting motor control system.

Referring now to FIG. 1, an electric starter is illustrated. This electric starter or cranking apparatus includes an electric cranking motor designated by reference numeral 10 and a solenoid designated by reference numeral 12. The solenoid is supported by the housing of the cranking motor in a manner well known to those skilled in the art, for example in a manner disclosed in the U.S. patent to Schneider et al. U.S. Pat. No. 2,862,391. The electric cranking motor 10 has field coils 10A and an armature winding 10B. The armature winding is carried by the rotatable armature core of the cranking motor. One end of the field coil 10A is connected to a terminal or junction 14. The field coils 10A are connected in series with the armature winding 10B. The armature winding 10B forms part of a rotatable armature that has a shaft 15 which carries and drives the pinion gear 17 of the electric starting apparatus in a manner well known to those skilled in the art. The armature winding 10B is further connected with a commutator, which has not been illustrated, that is engaged by brushes which are also not illustrated. One of the brushes is connected between the field windings 10A and the armature winding 10B and the other brush is connected between the junction or terminal 16 and the opposite side of armature winding 10B. The junctions 14 and 16, as well as the field coils 10A and armature winding 10B, are all electrically insulated from motor vehicle ground and accordingly are all electrically insulated from the metallic housing of the cranking motor which is at motor vehicle ground when the cranking motor is secured to an engine.

The solenoid 12 has a hold-in coil 18 and a pull-in coil 20. These coils, when energized, cause a plunger to be shifted. The plunger in the drawing is identified by a dotted line designated by reference numeral 22. The plunger 22 operates a movable electrical contact 24 that cooperates with fixed electrical contacts 26 and 28. The plunger 22, when moved, causes the movable contactor 24 to engage the fixed contacts 26 and 28 to thereby electrically connect these contacts. The plunger 22 is further arranged to shift the pinion 17 into and out of mesh with the ring gear of an engine to be cranked. In this regard the dotted line 23 represents a shift lever that is connected to plunger 22 and which operates to move pinion 17 axially with respect to shaft 15. Shift lever apparatus for shifting the pinion is well known to those skilled in the art and disclosed in the above-referenced patent to Raver U.S. Pat. No. 4,586,467 and in the patents to Hartzell et al. U.S. Pat. No. 2,839,935 and to Dyer U.S. Pat. No. 2,287,791. The solenoid 12 is provided with a terminal 30 that is electrically connected to conductor 32. One side of the hold-in coil 18 and one side of the pull-in coil 20 are connected to conductor 32. The solenoid further has a terminal 34 that is electrically connected to an opposite side of hold-in coil 18. Terminal 34 is connected to junction 36 via conductor 38. The junction 36 is connected to motor terminal 16 via conductor 39 and is connected to the positive terminal of a 12 volt storage battery 40 by conductor 42. The negative terminal of the storage battery 40 is grounded, as illustrated.

The terminal 14 of cranking motor 10 is connected to a terminal 44 of solenoid 12. The terminal 44 is connected to one side of pull-in coil 20 and to fixed contact 26.

The solenoid has another terminal 46 which is connected to a conductor 48 and to the fixed contact 28. The conductor 48 is connected to ground, as illustrated.

The starting motor control system has an N-channel enhancement mode metal oxide field effect transistor Q1. This transistor has a gate G, a drain D and a source S. The drain of the transistor is connected to a conductor 50 by a conductor 52. The source S of the transistor is connected to conductor 48 via conductor 54. The gate of transistor Q1 is connected to a conductor 56 through a resistor R1. The conductor 56 is connected to one side of a manually operable start switch 58. The opposite side of this switch is connected to junction 36 via conductor 60.

Connected across the drain and source of transistor Q1 is a capacitor C1 and a resistor R3. A diode 62 is connected across resistor R3. A resistor R2 is connected between conductor 56 and conductor 48. A Zener diode 64 is connected between the gate of transistor Q1 and the source S of this transistor.

The transistor Q1 may be a Motorola type MTE200N06 field effect transistor which is capable of handling 200 amps between its drain and source. The resistors R1 and R3 may respectively have resistance values of 180 ohms and 1.2 ohms. The resistance of resistor R2 may be about 300 ohms and the capacitance of capacitor C1 may be about 1200 microfarads.

The operation of the motor control system shown in the drawing will now be described. When it is desired to cause the electric starter to crank an engine the switch 58 is closed. When this occurs, the positive voltage of the battery 40 is applied to the gate G of transistor Q1. The source of transistor Q1 is at the negative potential of battery 40 since it is connected to ground via conductor 54. Since the gate G is now positive, with respect to the source S by voltage of the battery, the transistor Q1 is biased conductive between its drain D and source S. When transistor Q1 is biased conductive the hold-in coil 18 and the pull-in coil 20 are both energized. The hold-in coil 18 is energized though a circuit that can be traced from the positive terminal of battery 40, through conductor 38, through hold-in coil 18, through conductors 32 and 52 to the drain of Q1, through the drain and source electrodes of Q1 and then back to the negative grounded side of battery 40 via conductor 54. The pull-in coil 20 is now energized via a circuit that can be traced from the positive terminal of the battery, through conductors 42 and 39, through armature winding 10B, through field coils 10A, through pull-in coil 20, through conductors 32 and 52 and then through transistor Q1 to the negative side of battery 40.

With the hold-in coil 18 and the pull-in coil 20 energized the pinion 17 of the starter will be moved into engagement with the ring gear of the engine and when this occurs the movable contactor 24 will be moved to engage the fixed contacts 26 and 28. The cranking motor 10 is now energized through a circuit that can be traced from the positive terminal of battery 40, through conductors 42 and 39, through the armature winding 10B and field coils 10A of motor 10, through the fixed contacts 26 and 28 that are bridged by contactor 24 to conductor 48 and then to the negative side of the battery 40 via ground. The cranking motor will now crank the engine.

When it is desired that engine cranking be terminated the switch 58 is opened. When switch 58 is open the positive voltage of battery 40 is no longer applied to the gate of transistor Q1 and accordingly there is no forward biasing voltage for transistor Q1. Transistor Q1 accordingly goes nonconductive to deenergize coils 18 and 20 and accordingly the contactor 24 shifts out of engagement with the fixed contacts 26 and 28. This shifting or opening movement of contactor 24 is provided by well known spring means, which has not been illustrated. This spring means also serves to shift the pinion 17 out of mesh with the ring gear of the engine.

The purpose of the Zener diode 64 is to limit the voltage applied to the gate G of transistor Q1. In a 12 volt system the break down voltage of Zener diode 64 may be approximately 20 volts. Thus, if an attempt is made to jump start the system with, for example, 24 volts the Zener diode will break down to limit the voltage applied to the gate of transistor Q1.

The purpose of resistor R1 is to limit the gate turn-on charge current. Resistors R1 and R2, in series, operate to provide a discharge path for the gate capacitance of transistor Q1 when it is biased off by the the opening of switch 58. Capacitor C1, resistor R3 and diode 62 provide for transient voltage snubbing. Thus, when coil 18 is deenergized a transient voltages is developed by coil 18. This transient voltage is applied to the series combination of capacitor C1 and resistor R3. The diode 62 acts as a voltage clamp for the voltage that is developed across R3 by the transient voltage. This snubber therefore limits the transient voltage that can be applied to the drain and source of transistor Q1 to a value of, for example of less than 60 volts.

Referring now to FIG. 2, a modified electric starting motor control system is illustrated which utilizes a plurality of parallel connected N-channel field effect transistors. In FIG. 2, the same reference numerals have been used as were used in FIG. 1 to designate components in FIG. 2 that are the same as the components of FIG. 1.

The system of FIG. 2, instead of using one field effect transistor Q1 uses four parallel connected N-channel enhancement mode medium power field effect transistors Q2, Q3, Q4 and Q5. Transistors Q2–Q5 may be a Siemens type BUZ 11-S2 field effect transistor. The drain electrodes D of these transistors are all connected to a conductor 70. The conductor 70 is connected to terminal 30 by a conductor 72. The source electrodes S of transistors Q2–Q5 are all connected to a conductor 74 which in turn is connected to conductor 75. The gate electrodes G of transistors Q2–Q5 are all connected to conductor 76 and to junction 78 through resistors R4.

The junction 78 is connected to one side of start switch 58 via resistors R5 and R6 and a conductor 79. The opposite side of start switch 58 is connected to the positive terminal of battery 40. The negative terminal of battery 40 is grounded as are conductors 75 and 80. The conductor 80 is connected between conductor 75 and terminal 46.

A diode 81 is connected across resistor R5. A silicon controlled rectifier (SCR) 82 has its anode connected to junction 83 and its cathode connected to conductor 75. The gate of SCR 82 is connected to junction 84 through resistor R7. A resistor R8 is connected between junction 84 and conductor 75. A Zener diode 85 is connected between junction 84 and conductor 72. A resistor R9 is connected between conductors 79 and 75. A capacitor C2 is connected between junction 78 and conductor 75.

An avalanche reverse voltage breakdown diode 88 is connected between conductors 70 and 75. A capacitor C3 is connected across avalanche diode 88.

When the start switch 58 is closed in the FIG. 2 system the transistors Q2–Q5 are biased conductive and accordingly the cranking motor is energized. When switch 58 is opened transistors Q2–Q5 go nonconductive and accordingly the cranking motor is deenergized to terminate engine cranking.

The system of FIG. 2 relies on a slowed-down turn-off time for transistors Q2–Q5 to thereby reduce the transient voltage developed between the drain and source of transistors Q2–Q5 when they are biased nonconductive. Putting it another way, the time it takes to turn-off transistors Q2–Q5 is increased. This transient voltage is due to deenergizing hold-in coil 18. The slowed-down turn-off of transistors Q2–Q5 is due to the provision of capacitor C2 and resistors R9, R6 and R5. When switch 58 is opened the positive terminal of battery 40 is disconnected from conductor 79 and the gate electrodes of transistors Q2–Q5. The capacitor C2, as well as the gate to source capacitance of transistors Q2–Q5, are charged when switch 58 is closed. When switch 58 is opened, capacitor C2 and the gate to source capacitance discharges through resistors R5, R6 and R9 so that the positive voltage applied to the gates of transistors Q2–Q5 decreases as capacitor C2 and the gate to source capacitance discharge. This provides the slowed-down turn-off of transistors Q2–Q5. Further, transient voltage protection for transistors Q2–Q5 is provided by avalanche diode 88 and capacitor C3 which act as a voltage snubber.

When switch 58 is closed, to cause transistors Q2–Q5 to be biased conductive, the diode 81 shunts resistor R5 to cause the turn-on of transistors Q2–Q5 to be speeded-up by causing transistors Q2–Q5 to be quickly moved through their active linear regions. This aids in ensuring a quick turn-on of transistors Q2–Q5 in the event of an intermittent open in switch 58.

The purpose of SCR 82 and circuitry connected therewith is to inhibit operation of the cranking motor in the event that an attempt is made to jump-start the system with a voltage that is higher than the system voltage. Assuming that the system of FIG. 2 is a 12 volt system the battery 40 is a 12 volt battery. If an attempt is made to jump-start the system by connecting a direct voltage source of, for example 24 volts across battery 40 the system will prevent transistors Q2–Q5 from being biased conductive. Thus, the breakdown voltage of Zener diode 85 can be selected to be about 20 volts so that it will break down and conduct if 24 volts is applied across battery 40. When Zener diode 85 conducts the SCR 82 is biased conductive to connect or clamp the gates of transistors Q2–Q5 to grounded conductor 75. This biases transistors Q2–Q5 nonconductive.

The purpose of resistors R4 is to limit the gate surge current to transistors Q2–Q5. The current is also limited by resistor R6 and diode 81. Resistors R4 are also used to isolate the gates of transistors Q2–Q5 from each other and to dampen any parasitic oscillations developed between the drain and gate of these individual transistors.

In regard to the physical construction of the system shown in FIG. 2, the conductor 70 can take the form of a block of metallic material that supports transistors Q2–Q5. This block is electrically connected to the drain electrodes of transistors Q2–Q5. This block of metal therefore serves as an electrical connector for connecting the drain electrodes together and as a heat sink for transistors Q2–Q5. Further, the conductor 74 can take the form of a plate of metallic material that is connected to the source electrodes of transistors Q2–Q5. In the final assembly of the parts a printed circuit board that carries other components of the FIG. 2 system can be sandwiched between the block and the plate. The described assembly can be secured to the end housing of a cranking motor.

The embodiments of the invention in which an exclusive property or privilege is claimed are defined as follows:

1. An electric starting system for cranking an engine comprising, an electric starter comprising an electric cranking motor and a solenoid having pull-in and hold-in coils and a shiftable plunger, said cranking motor having first and second terminals, a pinion driven by said motor that is shifted by movement of said plunger that is adapted to mesh with the ring gear of an engine, switch means having first and second contacts that are at times electrically connected by a contactor that is shiftable by movement of said plunger, a manually operable start switch, at least one N-channel enhancement mode field effect transistor having a drain, a source and a gate, a source of direct voltage having positive and negative terminals, means connecting the positive terminal of said voltage source to said first terminal of said cranking motor, means connecting said pull-in coil between the said second terminal of said cranking motor and the drain of said transistor, means connecting said source of said transistor to said negative terminal of said voltage source, means connecting said hold-in coil between the positive terminal of said voltage source and the drain of said transistor, means connecting one of the contacts of said switch means to said second terminal of said cranking motor, means connecting the other contact of said switch means to said negative terminal of said voltage source and means connecting said start switch between said positive terminal of said voltage source and the gate of said transistor whereby when said start switch is closed said transistor is biased conductive between its drain and source, said transistor when conductive causing said pull-in and hold-in coils to be energized to thereby cause said movable conductor to be shifted into engagement with said fixed contacts.

2. The starting system according to claim 1 wherein a Zener diode is connected across the gate and source of said transistor to limit the voltage applied to the gate from said start switch.

3. The starting system according to claim 1 wherein a series circuit comprised of a capacitor and a resistor are connected between the drain and source of said transistor and further wherein a diode is connected across the resistor, the diode being so connected that its cathode is connected to the source of said transistor.

4. The starting system according to claim 1 wherein said at least one transistor comprises a plurality of parallel connected N-channel enhancement mode field effect transistors.

5. The starting system according to claim 1 wherein a controlled rectifier is connected across the gate and source of said transistor and wherein said controlled rectifier is biased conductive by voltage responsive means to bias said transistor nonconductive in the event that a voltage exceeding a predetermined magnitude is applied to said system.

6. The starting system according to claim 1 wherein a capacitor is connected across the gate and source of said transistor, said capacitor being charged when said start switch is closed and discharging through resistor means when said start switch is opened, the charge and subsequent discharge of said capacitor operative to increase the time required to turn-off the transistor from the time that said start switch is opened.

7. The starting system according to claim 1 wherein the means connecting said start switch between said positive terminal of said voltage source and the gate of said transistor comprises a resistor that is shunted by a diode.

* * * * *